US009111426B2

(12) United States Patent
Engelmann et al.

(10) Patent No.: US 9,111,426 B2
(45) Date of Patent: Aug. 18, 2015

(54) RECREATIONAL SMOKING MONITOR SYSTEM FOR USE IN OCCUPIED SPACES

(71) Applicant: SFJC, LLC, St. Paul, MN (US)

(72) Inventors: Christopher E. Engelmann, St. Paul, MN (US); Kevin Nicholson, St. Paul, MN (US); Quang (Tim) Nguyen, Minneapolis, MN (US); Kelvin A. Kosbab, Boulder, CO (US); Michael J. Masek, Shoreview, MN (US); Jeffrey R. Frank, Bloomington, MN (US)

(73) Assignee: SFJC, LLC, St. Paul, MN (US)

( * ) Notice: Subject to any disclaimer, the term of this patent is extended or adjusted under 35 U.S.C. 154(b) by 94 days.

(21) Appl. No.: 13/936,718

(22) Filed: Jul. 8, 2013

(65) Prior Publication Data

US 2014/0015681 A1 Jan. 16, 2014

Related U.S. Application Data

(60) Provisional application No. 61/669,224, filed on Jul. 9, 2012.

(51) Int. Cl.
*G08B 17/10* (2006.01)
*G08B 17/103* (2006.01)

(52) U.S. Cl.
CPC ..... *G08B 17/103* (2013.01)

(58) Field of Classification Search
CPC ..... G08B 17/00; G08B 17/10; G08B 17/125; G08B 17/103; G08B 17/107; G08B 17/117; G08B 21/182; G08B 25/00; G08B 25/009; G08B 25/014; G08B 25/045
USPC ..... 340/506, 521, 525, 539.1, 577, 584, 340/588, 628, 630, 825.49
See application file for complete search history.

(56) References Cited

U.S. PATENT DOCUMENTS

| | | | | |
|---|---|---|---|---|
| 3,678,487 | A * | 7/1972 | Ludewig et al. | 340/507 |
| 5,552,775 | A * | 9/1996 | Harley | 340/628 |
| 5,708,414 | A * | 1/1998 | Peltier et al. | 340/506 |
| 6,396,405 | B1 * | 5/2002 | Bernal et al. | 340/630 |
| 6,545,608 | B1 * | 4/2003 | Kaufman | 340/577 |
| 2005/0046563 | A1 * | 3/2005 | Whitney | 340/506 |
| 2005/0083205 | A1 * | 4/2005 | Deacy | 340/628 |
| 2006/0265195 | A1 * | 11/2006 | Woodard et al. | 702/188 |
| 2006/0267756 | A1 * | 11/2006 | Kates | 340/521 |
| 2007/0008157 | A1 * | 1/2007 | Siemens et al. | 340/577 |
| 2009/0256714 | A1 * | 10/2009 | Loepfe et al. | 340/628 |

* cited by examiner

*Primary Examiner* — Hung T Nguyen
(74) *Attorney, Agent, or Firm* — Nawrocki, Rooney & Sivertson, P.A.

(57) ABSTRACT

A system detects presence of particles in the air of guest rooms of facilities such as motels and hotels for example that indicate that guests are engaged in recreational smoking. The system provides an indication to the facility manager of such behavior.

15 Claims, 7 Drawing Sheets

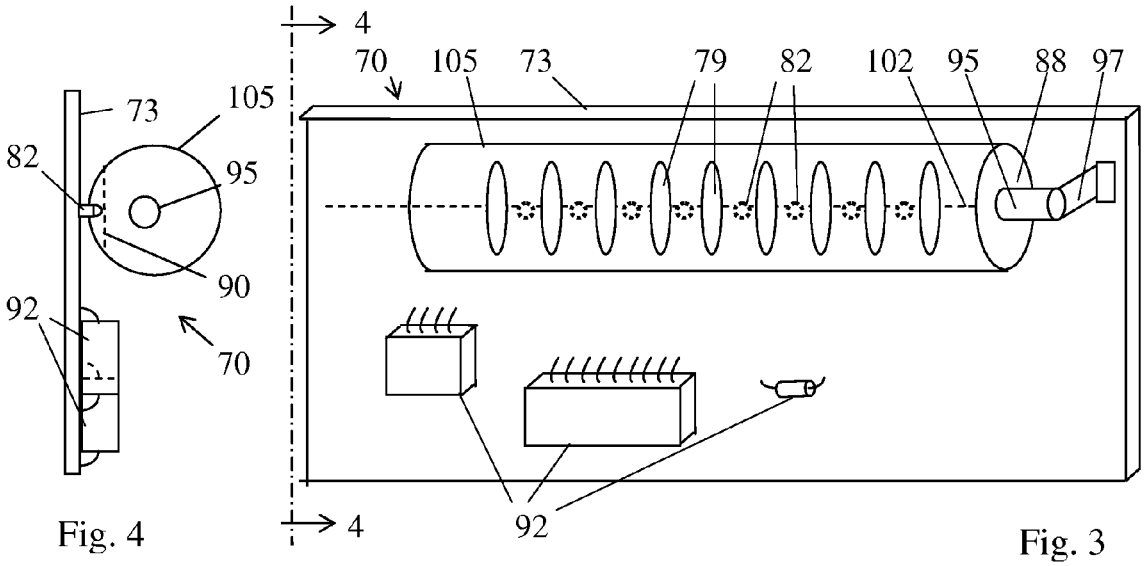
Fig. 4
Fig. 3
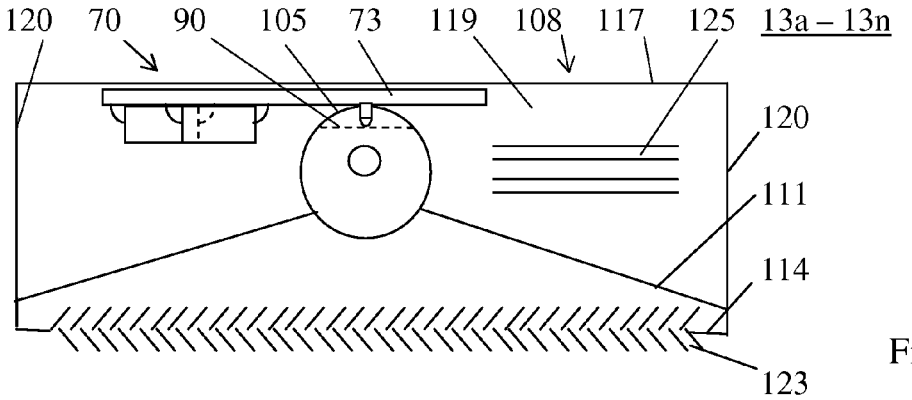
Fig. 5

*Radio Transceiver*

*Wein Bridge Oscillator*

RECREATIONAL SMOKING MONITOR SYSTEM FOR USE IN OCCUPIED SPACES

CROSS-REFERENCE TO RELATED APPLICATIONS

This is a regular application filed under 35 U.S.C. §111(a) claiming priority, under 35 U.S.C. §119(e)(1), of provisional application Ser. No. 61/669,224, previously filed Jul. 9, 2012 under 35 U.S.C. §111(b).

BACKGROUND OF THE INVENTION

A continuing problem for motels and hotels principally, but sometimes for other occupied spaces as well, are guests that smoke in non-smoking rooms. Usually but not always, guests smoke tobacco, but other products, often illegal, may be smoked as well. The term "recreational smoking" is intended to include tobacco smoke, marijuana smoke, and other types of substances legal and illegal, smoked by persons to alter their mood or because of an existing dependency.

The problem also arises in schools where students smoke in rest rooms, etc., in facilities where smoking creates an immediate safety hazard, and possibly in other facilities as well. The problem is compounded by the fact that in motel, hotel, and rest room situations, camera surveillance is simply deemed unacceptable.

Regardless of the type of recreational smoking product involved, the cost to clean and sanitize a room or other space after a guest has illicitly smoked in it can run to hundreds of dollars. The possible allergic reactions suffered by later occupants of a room in which someone has previously smoked may require that cleaning the residues of recreational smoking on drapes, carpeting, walls, and furnishings be very thorough. Further, even if there is no health issue, a motel or hotel that holds out a room as "No Smoking" must assure its guests that that room has not had a previous guest smoking in it.

Even though terms of conduct for a guest may clearly state that no smoking is permitted in the particular room, a certain fraction of guests unfortunately believe that the requirement does not apply to them, or that they will not be caught if in breach of the requirement. Yet when illicit smoking occurs, it is difficult for the establishment to recover this loss from the responsible guest. The problems of proof and collection from the guest often make it simpler for the establishment to accept the loss.

One can thus see that a system that can reliably detect most incidents of recreational smoking within a space with few or no false positives would pay high dividends in first of all, allowing the establishment to impose immediate sanctions on the guest, and secondly, allow charging the costs of cleaning the room back to the guest on a credit card. Further, knowledge by a guest that a reliable recreational smoking detector is present in the occupied room will serve as a significant deterrent to recreational smoking in the first place.

Accordingly, a means for real time detection of illicit smoking with a high degree of accuracy is desirable. To date, such means are not available as far as is now known to the inventors.

Available smoke detectors for room and structure fires are not suitable for distinguishing the combustion products of tobacco and other recreational smoking from a real fire. Combustion products produced by recreational smoking typically differ only slightly from those produced by the structure and its contents during an actual fire.

Distinguishing recreational smoking combustion products from those of a real structure fire is therefore not easy. Yet, an establishment acting on a false positive will very likely create bad will on the guests' part toward the establishment. False negatives will allow a smoking guest to avoid detection. At the same time, the establishment must be respectful of the guests' privacy.

These problems and the constraints on solutions to them have created problems for the hospitality industry. But detecting in real time in a room, the presence of recreational smoking has proven to be difficult.

BRIEF DESCRIPTION OF THE INVENTION

The inventors find that presence in a room of air-borne particles with maximum dimensions of 100-300 nm is a reliable indicator of recreational smoking in that room. Further, the inventors have developed an inexpensive and reliable system for detecting the presence of such particles.

Such a system can detect presence of recreational smoke in the air of first through nth individual rooms of a facility, each room having a unique room designator assigned thereto.

The system comprises first through nth room sensors, each to be mounted on one of a wall and a ceiling of each of the first through nth rooms respectively. Each of said sensors provides a smoke level signal indicating the concentration of combustion products such as air-borne particles with maximum dimensions of 100-300 nm unique to recreational smoke in the air of the room in which the sensor is mounted. Each such room sensor further encodes in the smoke level signal, an identifier such as a room number assigned to the room in which the sensor is mounted.

A monitor station receives and analyzes each smoke level signal, and provides a room status signal indicating that recreational smoke is present when that is the case. The monitor also encodes the room identifier in the smoke level signal. In one preferred embodiment, this functionality forms a part of the facility computer.

A display unit forming a part of the facility computer provides the room number and the status of the room as having recreational smoking therein usually as a visual display signal but also potentially as an auditory signal.

At least one of the room sensors may comprise a cylindrical chamber having a plurality of openings along the axial length thereof. A light source such as a laser diode is mounted at one end of the chamber to project a light beam through the chamber along a predetermined path.

A light sensor having a sensing surface is mounted adjacent to the chamber with the sensing surface facing toward and spaced from the light beam path. The light sensor detects light scattered by recreational smoke in the chamber, and provides a sensor signal whose level is proportionate to the concentration of recreational smoke products in the air in the chamber.

A signal analyzer receives the sensor signal and computes from it a numerical value indicating the concentration of recreational smoke combustion products in the air in the chamber. The signal analyzer then produces an analyzer signal encoding that numerical value.

A transmitter receives the analyzer signal and providing the smoke level signal as well as a room sensor ID value associated with the room sensor.

The light source in each room sensor may provide a light beam whose wavelength is in the range of wavelengths including about 650 nm. Although this is not an ideal wavelength since one prefers to closely match the wavelength to the maximum dimension of recreational smoking particles, which is on the order of 100-300 nm., it is adequate to detect most recreational smoking particles. A preferred light source is of the type producing a beam having substantial energy in the 100-300 nm. wavelength range, but the current cost of such a light source is too high for most applications.

Preferably, the chamber has an interior wall having a reflective surface, and the light beam passes between the sensor and at least a part of the interior chamber wall, wherein the interior chamber wall reflects toward the light sensor's sensing surface, light impinging on the chamber wall.

Preferably there is an optical filter within the chamber interposed between the light beam and the sensor. The optical filter preferably is of the type that blocks a greater fraction of light whose wavelength is above and below a range of wavelengths including a 650 nm. wavelength than is blocked within said range.

The transmitter in the room sensors preferably comprises a RF transmitter, and the monitor station includes a RF receiver.

The room sensor may include an enclosure having a plurality of walls and enclosing the chamber. The enclosure may include at least one baffle extending from an enclosure wall to the chamber. The interior surfaces of the enclosure may be light-absorbing.

The room sensor may include an enclosure having a plurality of walls and enclose the chamber. At least one of these walls includes a vent in proximity to the openings in the chamber. Such a vent may comprise a grate having two series of oppositely oriented and linearly staggered fins.

The room sensor may include a driver providing power voltage to the light source. The power voltage periodically varies between two levels. The light source receiving this power voltage provides a beam whose intensity is proportionate to the power voltage. The signal analyzer for such a room sensor includes a multiplier element receiving the power voltage and the sensor signal and providing a signal indicative of the product of a plurality of samples of each of the sensor signal level and the power voltage. An integrator receives the multiplier signal and integrating the values in the multiplier signal.

Preferably the light source is a laser diode. Such a laser diode may provide a light beam having one of a wavelength of 100-300 nm. and a wavelength near 650 nm.

The light source may be mounted to place the beam in closer proximity to the sensor's sensing surface than to an opposite wall of the chamber.

BRIEF DESCRIPTION OF THE DRAWINGS

FIG. 3 is a perspective view of the circuit board in a room sensor including a recreational smoke detector as mounted on the circuit board.

FIG. 4 is an edge elevation view of the circuit board in a room sensor including a recreational smoke detector mounted on the circuit board.

FIG. 5 is an end projective view of the interior of an enclosure for a room sensor, including the circuit board and enclosure features.

DESCRIPTION OF THE PREFERRED EMBODIMENTS

Figure 1:
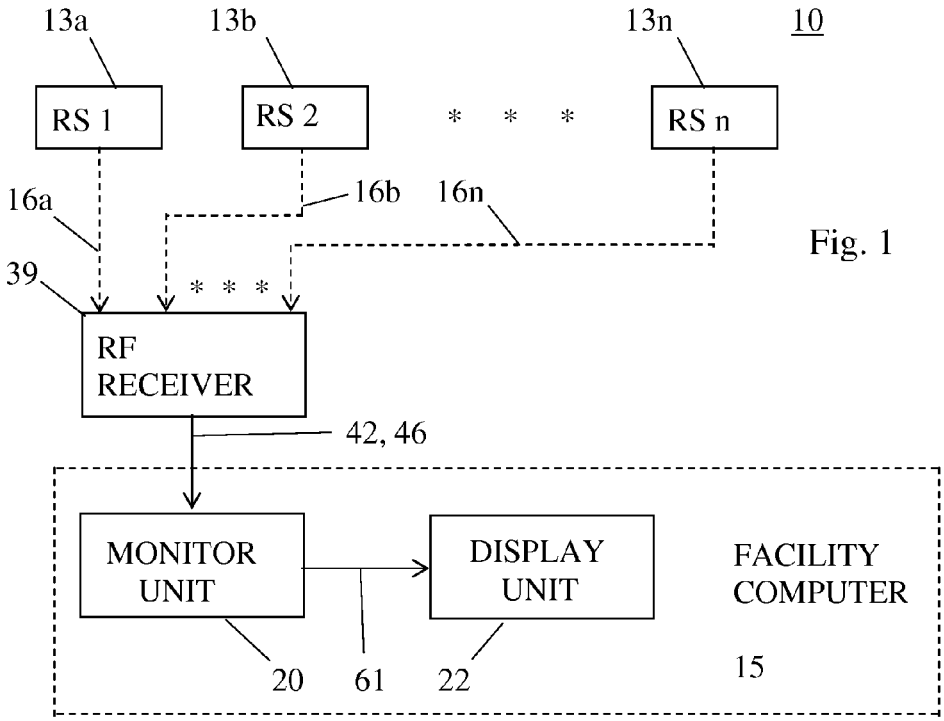
FIG. 1 is a block diagram of the invention.

Turning first to FIG. 1, the block diagram therein shows the major elements of a recreational smoke detection system 10 for hospitality structures. Each room of a hospitality structure has mounted within it a room sensor 13*a*-13*n*. The room sensor 13*a*-13*n* in a particular room electronically determines the level of recreational smoke products in the air within that room. Periodically, in one embodiment 0.5 sec., each room sensor 13*a*-13*n* provides on its associated path 16*a*-16*n*, a smoke level signal as an output that encodes the level of detected recreational smoke products.

Each room sensor 13*a*-13*n* has a dedicated data link 16*a*-16*n* that carries the smoke level signals a room sensor 13*a*-13*n* generates, to a monitor unit 20. In some embodiments, a single data link may be shared by a number of the room sensors 13*a*-13*n*. One preferred embodiment for the data links uses a RF connection having a MiWi connection, but the room sensors 13*a*-13*n* can be hard wired as well to the monitor unit 20. MiWi is a proprietary RF communication system available from Microchip Technology, Chandler, Ariz.

In any case, a smoke level signal must be associated in some way with the specific room sensor that generates that smoke level signal. In this embodiment, each room sensor 13*a*-13*n* has a pre-assigned sensor ID that is included with the smoke level signal from each room sensor 13*a*-13*n*.

An RF receiver 39 receives each transmission from each room sensor 13*a*-13*n* and provides the room sensor ID and smoke level signal from that room sensor 13*a*-13*n* to monitor unit 20 on the path labeled "42, 46."

In one preferred embodiment, monitor unit 20 and display unit 22 form a part of a facility computer 15 that executes suitable software to cause computer 15 to perform the functions of units 20 and 22.

The monitor unit 20 interprets the smoke level signals that each individual room sensor 13*a*-13*n* provides. When a smoke level signal value exceeds a preset value, this indicates that recreational smoke products are currently present in the air of the room in which the room sensor 13*a*-13*n* whose ID was encoded in the RF signal being processed. The management of the establishment can then take whatever steps are appropriate to address the situation.

Figure 2:
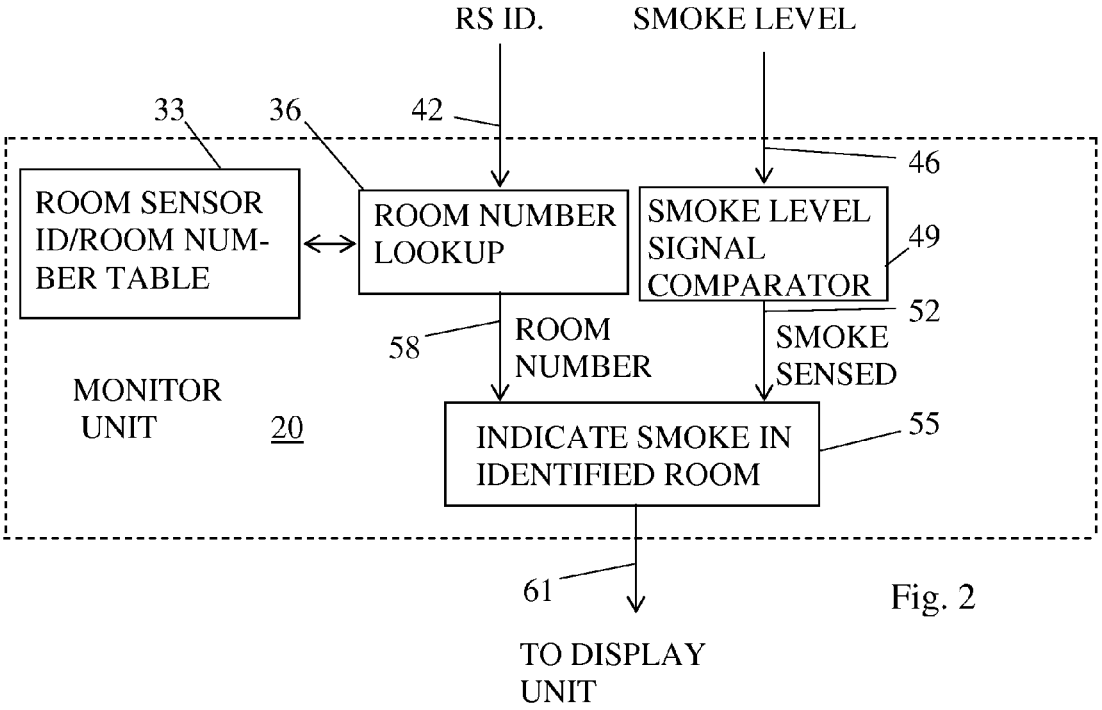
FIG. 2 is a block diagram of a monitor unit for analyzing smoke level signals received from a room sensor.

FIG. 2 is a more detailed block diagram of the monitor unit 20. The RF receiver 39 provides to monitor 20 encoded in a signal carried on a path 42, the room sensor ID provided by the current RF signal from a room sensor 13*a*-13*n*. Similarly, the RF receiver 39 provides to monitor 20 on a path 46, each smoke level carried by the current RF signal.

Typically, the signals received by receiver 39 are spaced so far apart that they will not conflict, or to use the technical term, collide, and corrupt each other. The MiWi protocol has mechanisms to deal with collisions, but if for example each room sensor 13*a*-13*n* transmits for one millisecond every 5 seconds, one can see that even 200 room sensors will only rarely issue colliding signals. Even then, detecting colliding signals is easy to do, so no erroneous determination of presence of recreational smoke in a room occurs. The odds are extremely small that a single room sensor 13*a*-13*n* will experience two sequential collisions.

In one embodiment, monitor unit 20 comprises a facility computer 15 that has many other functions, such as billing and reservations for example. The facility computer has software that performs the various functions forming a part of the invention.

Each room sensor 13*a*-13*n* uses a microcontroller 200 (see FIG. 9) that executes firmware to perform many of the functions in the individual room sensor 13*a*-13*n*. When a microcontroller executes the invention's software or firmware, it becomes during that time, special purpose hardware dedicated to perform the computations that the system currently requires. In the example at hand, the software or firmware code that executes to allow a microcontroller to implement the invention may be considered to have been reconfigured as hardware elements whose components perform the computations that implement the invention.

That is, the components (logic gates and memory elements) comprising a microcontroller 200, while executing the firmware, actually change their physical structure. These altered components comprise nothing more than complex electrical circuitry that send and receive electrical signals exactly as would a non-programmable circuit that executes the invention's functions. In the course of this firmware execution, the components undergo many physical changes as signals pass into and from them.

For example, at the elemental level, a logic gate within microcontroller 200 typically undergoes many physical changes while the microcontroller executes the invention's firmware. Such physical changes typically comprise changes in the level of electrons within the gate. These changes alter the impedance between the various terminals of the gate, in this way allowing the microcontroller 200 to execute individual instructions of the firmware.

Another way to think of this is to consider the effect of executing the firmware code as setting literally tens of thousands of interconnected switches within the microcontroller to their on and off states. These switches then control changes in the state of other switches, so as to effect the computations and decisions typical of firmware to execute the algorithms of the invention.

The mere fact that these microcontroller components are too small to be seen, or exist only for short periods of time while the relevant code executes is irrelevant as far as qualifying as patentable subject matter. Nothing in our patent law denies patent protection for inventions whose elements are too small to be seen or whose elements do not all exist simultaneously or for only short periods of time.

Accordingly, claims defining this invention having elements formed by software or firmware execution in microcontroller 200 must be treated in the same way as an invention embodied in fixed circuit components on a circuit board. There is no reason to do otherwise.

The monitor unit 20 of FIG. 2 comprises a number of functional blocks within facility computer 15. Each of these functional blocks comprises hardware element that performs the function specified for it by executing appropriate software. The arrows connecting them are data paths, with the arrows indicating the direction of data flow. In real life these arrows correspond to electrical paths within the microcontroller that carry signals encoding the data. As with microcontroller 200 for the room sensor 13*a*-13*n* functions, the facility computer 15 actually becomes each of the functional elements of FIG. 2 for short periods of time.

In FIG. 2, for each RF signal from a room sensor 13*a*-13*n*, the signal path 42 carries the room sensor ID encoded in the room sensor signal to a room number lookup element 36. A memory forming part of facility computer 15 includes a memory element 33 holding a room sensor ID/room number table 33 that associates each room sensor ID with the physical room in which the room sensor is located.

Room number lookup element 36 uses the room sensor ID value to retrieve from element 33, the room number of the room holding the room sensor 13*a*-13*n* supplying the signal currently being processed. The values in memory element 33 will typically be supplied by the user. The lookup element 36 places the room number of the room holding the room sensor whose RF signal is being processed on a data path 58.

Receiver 39 also decodes the portion of the RF signal carrying the smoke level value and places this value on a smoke level data path 46. A comparator element 49 determines if the smoke level value on path 46 indicates a level of recreational smoke particles in the room creating a high probability that an occupant is smoking. If so, element 49 places a smoke sensed signal on a path 52.

A display unit 55 receives the smoke sensed signal and the room number, and responsive to the smoke sensed signal provides the room number and the status of the room encoded in at least one of a visual display signal and an auditory signal.

FIGS. 3-5 show a module 70 forming a part of each room sensor 13*a*-13*n*. A circuit board 73 carries electrical components 92 of the module 70, only a few of these being shown. Conductors forming a part of circuit board 73 but not shown in FIG. 3, electrically interconnect the components 92. FIGS. 5-14 are schematics of the actual individual circuits forming module 70.

The module 70 detects recreational smoking within a room by detecting an excess of particles in the 100-300 nm size range in the air of the room. Tests suggest that presence of particles of this size in room air strongly correlates with tobacco smoke in that air.

A hollow, cylindrical detector tube 105 is mounted on circuit board 73. Tube 105 has a series of transverse slots 79 extending along the axis. The interior 88 of tube 105 should be highly reflective to increase the amount of light backscattered from recreational smoking particles. For example, the interior wall of tube 105 may be lined with highly reflective foil.

A series of phototransistors 82 extend axially along and within tube 105 in general diametric opposition to slots 79. Phototransistors 82 are connected to conductors in circuit board 73. Other circuit components are shown generically at 92. Phototransistors 82 have sensing surfaces generally facing the center of the detector tube 105.

A laser diode 95 is mounted on circuit board 73 using a bracket 97 and oriented to direct a light beam 102 through tube 105. A small percentage of photons from beam 102 will be scattered or reflected toward phototransistors 82. When a sufficient number of these photons is detected, one can conclude with a high degree of certainty that smoking is occurring in the room where circuit board 73 is mounted.

FIG. 5 shows a room sensor 13*a*-13*n* as comprising the module 70 and an enclosure 108. FIG. 5 presents a view of the interior of enclosure 108 perpendicular to the laser beam, and in which module 70 is mounted. Enclosure 108 may be generally rectangular with six walls. Top 117 and two side walls 120 may be solid.

Enclosure 108 has a bottom wall having a grille or grate 114 with slots 123 that allow air potentially carrying recreational smoke particles to enter enclosure 108. Two end walls 119 of which only one is shown may have vents or slots 125. Vent slots 125 may also enhance circulation of air through enclosure 108. Improved circulation may improve speed and accuracy of recreational smoking detection. However, preliminary experiments suggest that forced convection through enclosure 108 may not be beneficial in improving sensitivity.

A room sensor 13*a*-13*n* normally will be mounted on a ceiling of a room, and oriented as shown in FIG. 5 with top 117 against the ceiling and grate 114 facing downwardly. In general, it seems best to mount enclosure 108 approximately in the center of the room. This has not yet been fully resolved however, and it may be that one or more room sensors 13*a*-13*n* mounted on one or more walls of the room involved will yield improved detection.

The sensitivity and reliability of smoke detection is enhanced by taking a number of steps in the design of module 70 and enclosure 108. It is likely but not certain that sensitivity of detection is improved by mounting laser diode 95 to cause beam 102 to pass in closer proximity to sensors 82 than to an opposite wall of the chamber. FIGS. 4 and 5 show beam 102 closer to phototransistors 82 than to the center of tube 105 for example.

Sensitivity also improves if the wavelength of beam 102 closely matches the size of the smoke particles. Unfortunately, at this time a laser diode 95 that produces a beam 102 with a wavelength in the range of 100-300 nm typical of recreational smoke particles is too expensive to be practical. Tests show however, that inexpensive laser diodes that produce a beam in the range of 640-655 (650 nominal) nm still yield adequate detection of particles whose size is in the range of 100-300 nm.

Sensitivity is further improved by limiting the amount of parasitic or exterior light that strikes phototransistors 82. To this end the interior of enclosure should be painted a matte, light-absorbing black. Grate 114 is shown as having two series or rows of oppositely oriented and linearly staggered fins 123 to limit the influx of light to the interior of enclosure 108 from the room itself. Vent slots 125 may have the form of a similar double row of fins.

An optical filter 90 excludes from reaching phototransistors 82, most light other than that in a fairly narrow range centered on the wavelength of laser diode 95. For example, a suitable filter 90 may exclude almost all light having a wavelength outside a range of 600-700 nm from reaching phototransistors 82.

Figure 6:
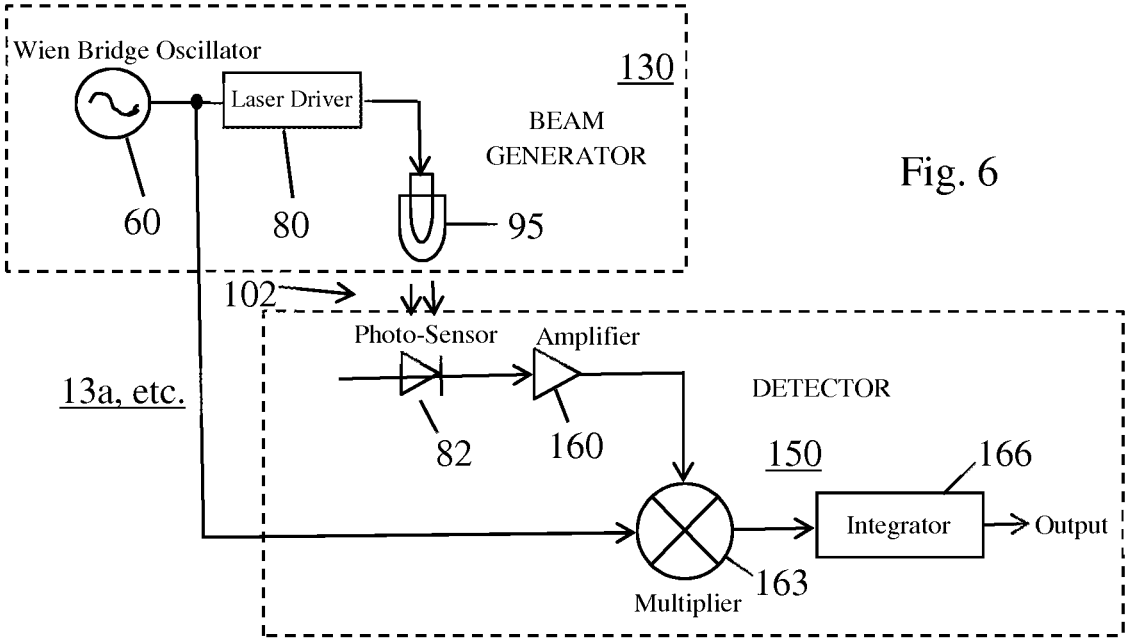
FIG. 6 is a block diagram of a room sensor showing the major elements thereof.

A pair of interior baffles 111 that extend from sides 120 to detector tube 105, form another feature that improves sensitivity and reliability of the room sensors 13*a*-13*n*. Baffles 111 may well direct particles-bearing air drifting through grate 114 more directly into detector tube 105. The pair of baffles 111 limit the volume within enclosure 108 that entering air must occupy, thereby concentrating the number of smoke particles within tube 105. Vents 125 may also improve circulation, and thereby increase speed and accuracy in detecting recreational smoke The block diagram of FIG. 6 shows the major functional elements of a room sensor 13*a*-13*n* as comprising a beam generator element 130 and a detector 150. Beam generator 130 includes a Wien bridge oscillator 60 that provides a signal to a laser driver circuit 80, and the laser diode 95.

Detector 150 comprises the phototransistors 82, an amplifier 160 receiving the digitized phototransistors 82 output, and a set of firmware functions implemented by microcontroller 200. As previously explained, microcontroller 200 physically becomes for brief periods, each of the hardware elements that perform these firmware functions.

The attached firmware source code as executed by microcontroller 200 forms the best mode known at this time for this implementation. It is likely that this firmware may not function as well or at all in other than the designated Microchip Technology microcontroller.

As is true for most microcontrollers, microcontroller 200 has an on-board A/D converter that digitizes both the amplifier 160 and the oscillator 60 outputs. These two signals are then multiplied and integrated according to well-known signal processing methods.

These elements comprise:

- an analog to digital converter 168*a* that digitizes the phototransistor transistor 82 output and transmit in a digitized phototransistor output signal
- an analog to digital converter 168*b* that digitizes the Wien bridge output and transmit in a digitized Wien bridge oscillator 60 output signal
- a multiplier element 163 receiving the Wien bridge oscillator 60 and the amplifier 160 output signals and providing a multiplier signal, and
- an integrator 166 receiving the multiplier signal from the multiplier element and providing an integration signal.

The multiplier element 163 and the integrator 166 form a signal analyzer.

Wien bridge oscillator 60 provides an offset sine wave of 1 khz to laser driver 80 and to multiplier 163. A part of the circuitry of microcontroller 200 and the firmware recorded in the microcontroller 200 memory forms multiplier 163 and integrator 166.

In one embodiment, over an interval of 11.278 ms, each of the Wien bridge oscillator 60 output and the amplifier 160 output are sampled 300 times at nearly identical times. Each value is converted to digital by A/D converters 168*a* and 168*b*. Each pair of digital values sharing the identical time of sampling are multiplied and recorded.

The multiplier 163 computations so recorded are provided to integrator 166 that integrates the values in the multiplier 163 output signal. In one embodiment, this integration comprises a summation of the multiplier 163 output for a sampling interval of 11.278 ms. The sampling interval length is not critical, but should be roughly an order of magnitude longer than a single cycle time of the Wien bridge oscillator 60 output.

The output signal of integrator 163 is normalized to a value falling between 1 and 24 and encoded in a smoke level signal. In one embodiment, a value of the smoke level signal between 1 and 5 indicates an insignificant concentration of recreational smoke particles in the room air, 6-9 indicates a low level of such particles, and any value above 10 indicates a significant level of such particles.

The smoke level signal from integrator 163 and a signal encoding the room number associated with the room sensor ID are supplied to the facility computer 15. FIG. 2 shows that the facility computer 15 tests the normalized integrator value to determine whether recreational smoking has occurred in the room with the encoded room number. If recreational smoking is detected, the facility system can provide a human-detectable indication of this situation. Receiver 39 may connect to the facility system with a USB cable.

The circuits that FIGS. 7*a*, 7*b*, and 8-14 show comprise a number of microcircuits of various types as well as discrete components. In general, the discrete components can be inexpensive ±10% devices, available from a variety of sources. Individuals with minimal knowledge of electrical engineering will be easily able to construct the hardware portions of this invention with these circuit diagrams and the following information.

Certain of the microcircuits are single source items, which are here identified by source and part number.

| Drawing ID | Item | Source | Part No. |
|---|---|---|---|
| | | Room Sensor | |
| U1 | microcontroller | Microchip Tech. | PIC18F26K80-I/SS |
| U2 | operational amplifier | Intersil | CA3240EZ |
| U3 | operational amplifier | Texas Insts. | LMV796MF/NOPB |
| U4 | operational amplifier | Diodes, Inc. | APX321WG-7 |
| U5 | volt. regulator | Fairchild Inst. | LM317LZ |
| U6 | transceiver | Microchip Tech. | MRF24J40MA |
| U7 | 3.3 v. regulator | Microchip Tech. | MCP1700T-3302E/TT |
| ZD1, ZD2 | Zener, 5.6 v. | ON Semiconductor | MMSZ5V1T1G |
| LD | 650 nm laser diode | Lasermate Group | LD65010A |
| | | Receiver 39 | |
| U1 | microcontroller | Microchip Tech. | PIC18F26K80-I/SS |
| U6 | transceiver | Microchip Tech. | MRF24J40MA |

U1 and U6 cooperate in each of a room sensor 13*a*-13*n* and in receiver 39 to control transmission and reception of data signals. Microchip Technologies have proprietary protocols that allow a user to for the most part ignore the RF signal generation and reception details, and simply insert into and extract from the RF signal, the desired information to be communicated from the data source (room sensor 13*a*-13*n* here) and provided to facility computer 15 by receiver 39.

Respecting transceiver 39, the firmware to cause U1 and U6 to operate as described is deemed so simple for someone familiar with these Microchip Technology devices and having minimal technical expertise in these electronic arts to develop, that it has not been included in this description.

Figure 7A:
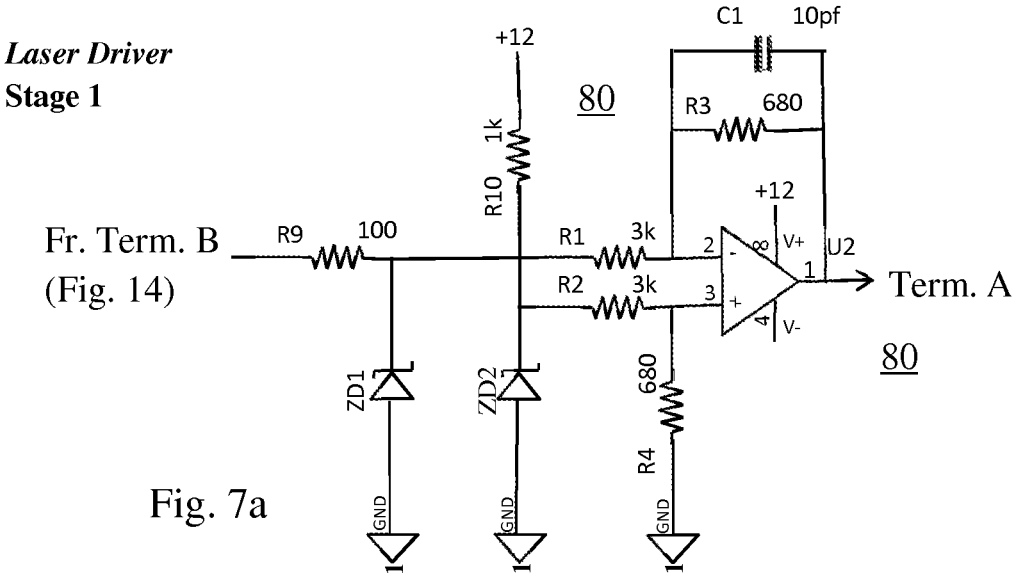
FIGS. 7*a* and 7*b* are circuit diagrams of the driver for a light source used in the recreational smoke detector.
Figure 7B:
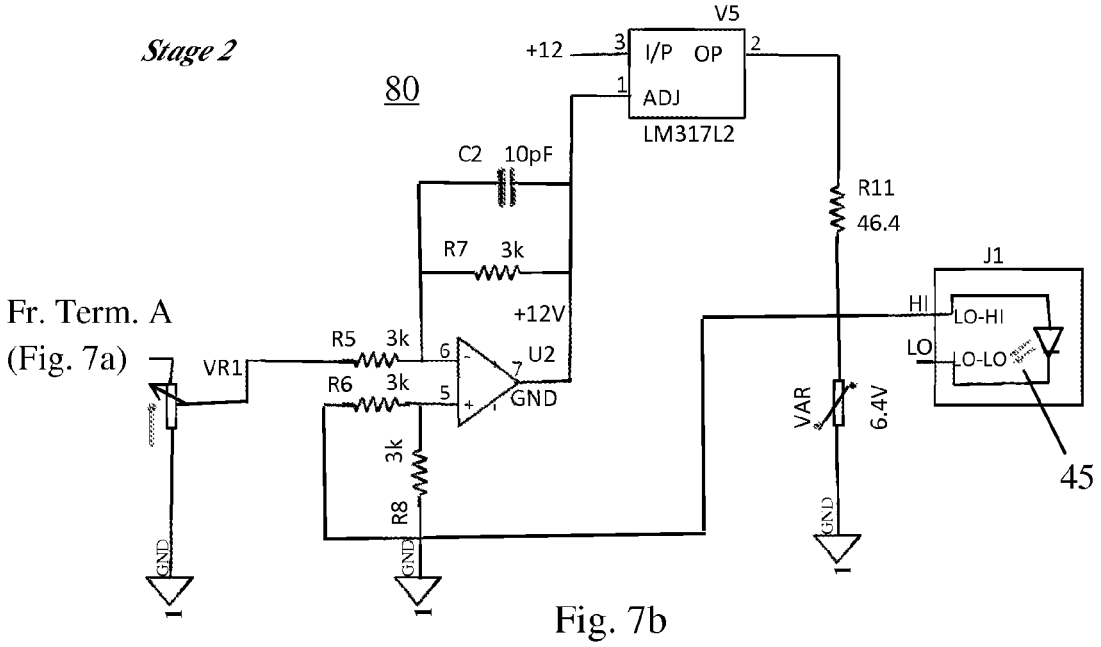

FIGS. 7*a* and 7*b* together show the circuitry for the two stages of the driver for laser diode 95. Stage 1 receives output from the Wien bridge oscillator 60 terminal B. The output of stage 1 of driver 80 is at terminal A, which is connected as shown to stage 2.

The intensity of the light beam that diode 95 provides is proportionate to the voltage across the HI and LO terminals of diode 95. Thus, the light intensity has a sine wave pattern with a 1 khz frequency.

Figure 8:
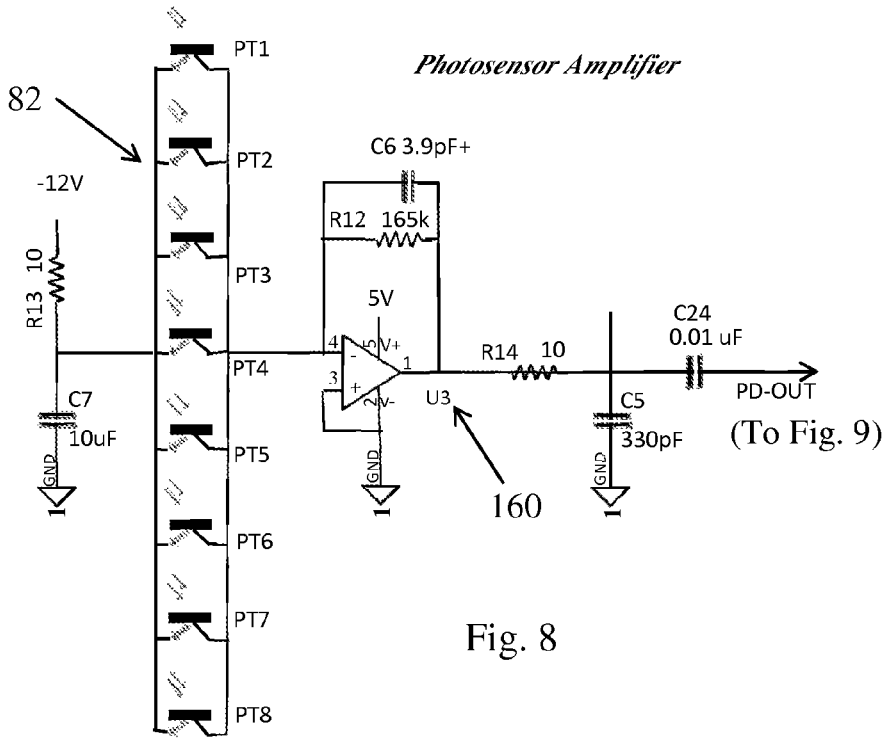
FIG. 8 is a circuit diagram of the amplifier for the signals generated by the recreational smoke detector.

FIG. 8 is the circuitry of the amplifier 160 that amplifies the phototransistors 82 output and supplies this amplified voltage in a PD-OUT signal to pin 2 of U1, microcontroller 200. Microcontroller 200 performs calculations on the signal that amplifier 160 provides that cause microprocessor 200 to function as multiplier 163 and integrator 166.

Figure 9:
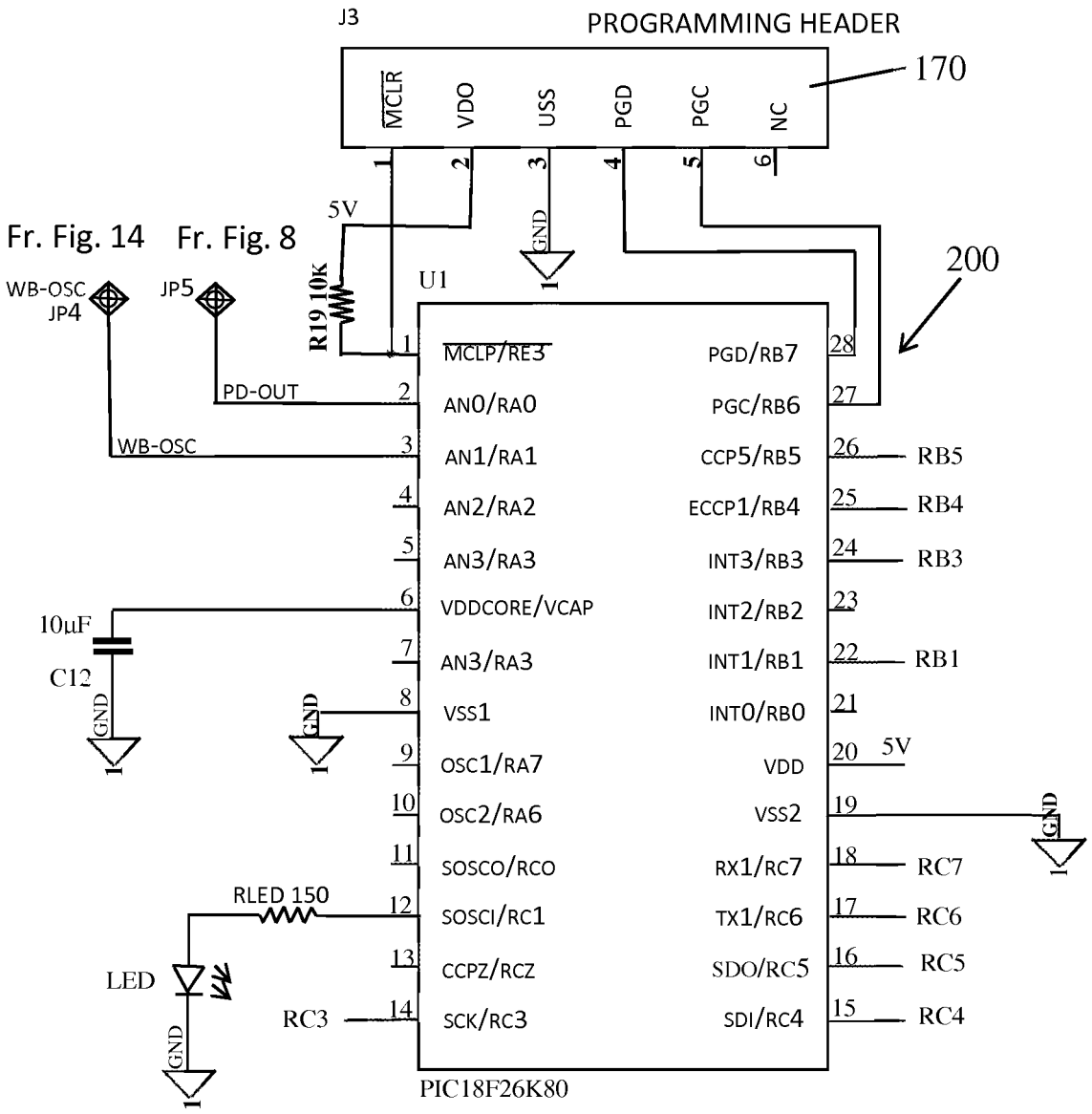
FIG. 9 shows the connections to a microcontroller that provides many of the room sensor functions.

FIG. 9 shows the microcontroller 200 and the connections to it. Microcontroller 200 receives the input at PD-OUT (pin 2) from amplifier 160 and digitizes it. Microcontroller 200 then functionally becomes the multiplier 163 and integrator 166 as it processes the signal that the amplifier 160 and the Wien bridge oscillator 60 provide.

Figure 13:
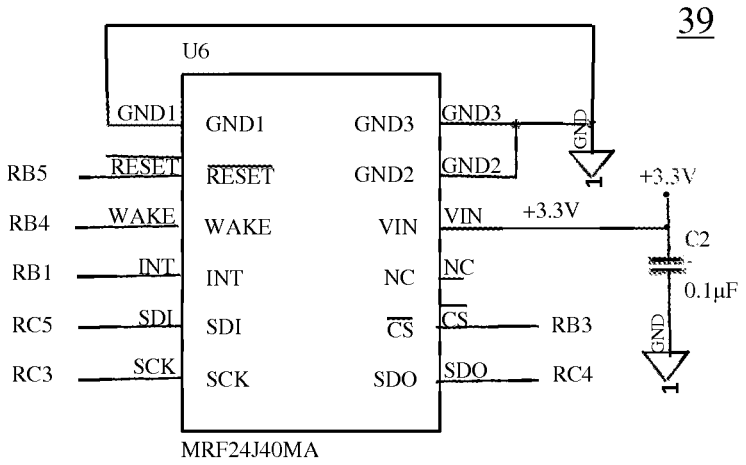
FIG. 13 shows the transceiver used in both the room sensor and in the RF receiver that provides data to the monitor unit.

Microcontroller 200 then provides room sensor ID and smoke level outputs to the transmitter portion of transceiver 39, see FIG. 13. These outputs eventually become the room sensor ID signal on path 42 and the smoke level signal on path 46, as FIG. 2 shows.

Figure 10:
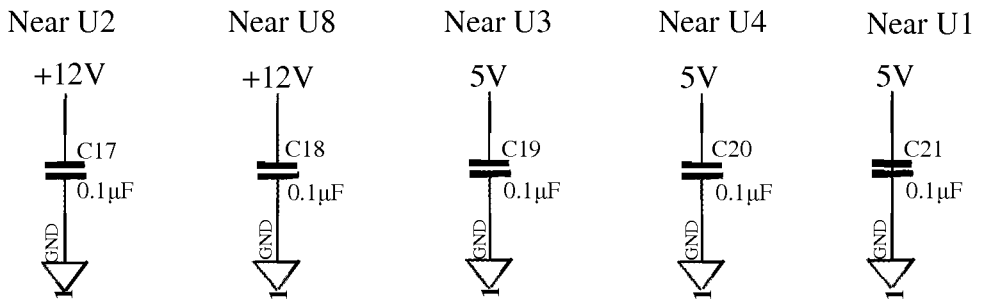
FIGS. 10-12 define preferred locations of various discrete circuit components relative to other circuit components.
Figure 11:
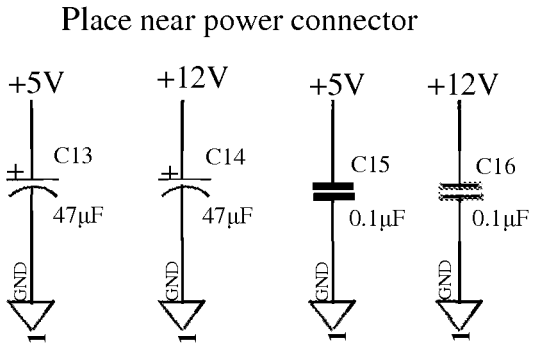
Figure 12:
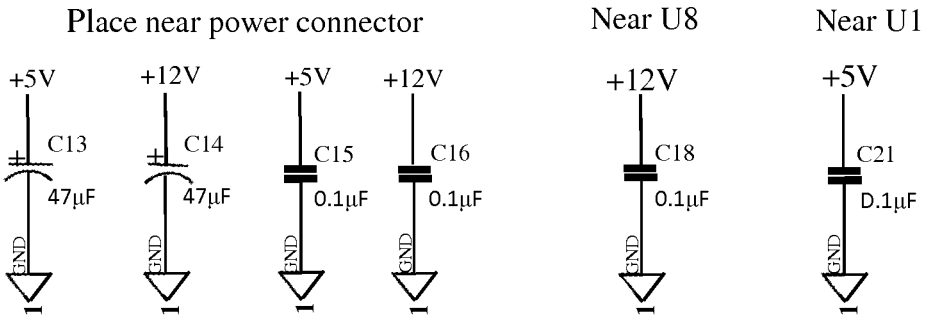

FIG. 10-12 show preferred placements of various capacitors. These placements will likely reduce noise and improve operation of the circuits.

FIG. 13 shows the details of transceiver 39. Microcontroller 200 provides all of the signal inputs to transceiver 39, but note that some of the transceiver 39 pins are connected to power and ground.

Figure 14:
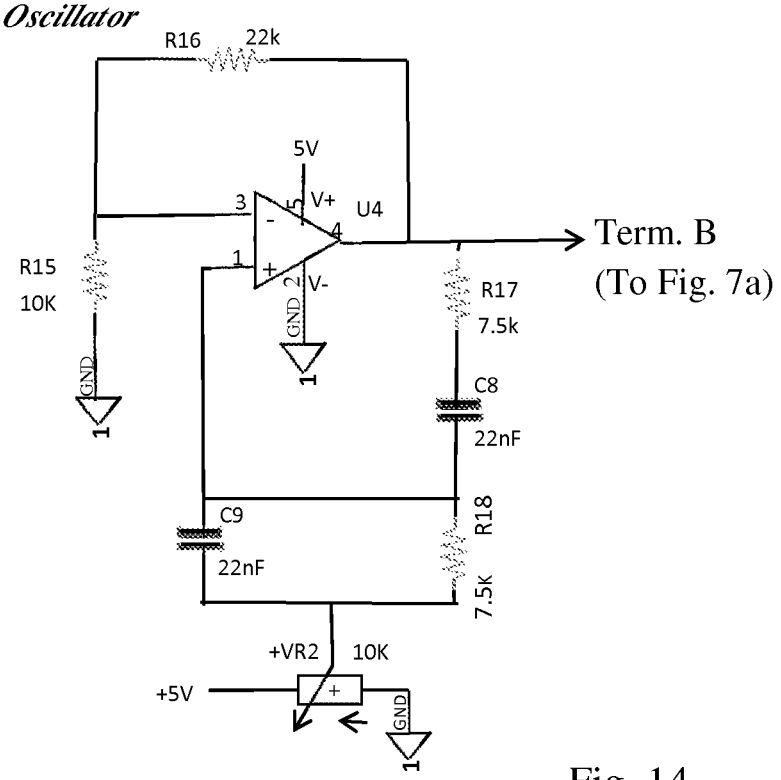
FIG. 14 is a circuit diagram of a Wien oscillator that provides the signal controlling the frequency at which the amplitude of the light source output is modulated.

FIG. 14 shows the details of the Wien bridge oscillator 60. The output at terminal B is a sine wave that oscillates between about 0 and 3 v at 1 khz. The output of oscillator 60 forms the inputs to laser driver 80 (FIG. 7*a*) and to microcontroller 200, pin 3, for the multiplication function. The 1 khz frequency is chosen to be far from most light noise source frequencies, such 60 hz power.

The source code attached hereto as Appendix A when compiled using a standard C compiler, produces object code that causes microcontroller 200 to operate in a way that implements certain of the functions of the room sensors 13*a*-13*n*.

What we claim is:

1. A system for detecting presence of recreational smoke in the air of first through nth individual rooms of a facility, each room having a unique room designator assigned thereto, comprising:

a) first through nth room sensors, each to be mounted on one of a wall and a ceiling of each of the first through nth rooms respectively, each of said sensors providing a smoke level signal indicating the concentration of combustion products unique to recreational smoke in the air of the room in which the sensor is mounted, said room sensor further encoding in the smoke level signal, an identifier assigned to the room in which the sensor is mounted;

b) a monitor station receiving and analyzing each smoke level signal, and providing a room status signal indicating one of the presence and absence of recreational smoke and further, encoding the room identifier;

c) a display unit providing the room number and the status of the room encoded in at least one of a visual display signal and an auditory signal;

d) wherein the at least one of the room sensors comprises:

a cylindrical chamber having a plurality of openings along the axial length thereof;

a light source mounted to project a light beam through the chamber along a predetermined path;

a light sensor having a sensing surface and mounted adjacent to the chamber with the sensing surface facing toward and spaced from the light beam path, said light sensor detecting light scattered by recreational smoke in the chamber, and providing a sensor signal whose level is proportionate to the concentration of recreational smoke products in the air in the chamber;

a signal analyzer receiving the sensor signal for computing a numerical value indicating the concentration of recreational smoke combustion products in the air in the chamber and producing an analyzer signal encoding that numerical value; and a transmitter receiving the analyzer signal and providing the smoke level signal.

2. The system of claim 1, wherein the at least one room sensor comprises a light source projecting light whose wavelength is in the range of wavelengths including about 650 nm.

3. The system of claim 1, wherein the chamber has an interior wall having a reflective surface, and the light beam passes between the sensor and at least a part of the interior chamber wall, wherein the interior chamber wall reflects toward the light sensor's sensing surface, light impinging on the chamber wall.

4. The system of claim 3, including an optical filter within the chamber and interposed between the light beam and the sensor, said optical filter blocking a greater fraction of light whose wavelength is above and below a range of wavelengths including a 650 nm. wavelength than is blocked within said range.

5. The system of claim 1, wherein the transmitter in the at least one room sensor comprises a RF transmitter, and wherein the monitor station comprises a RF receiver.

6. The system of claim 1 adapted to detect particles in recreational smoke combustion products having a maximum dimension in the range of approximately 100-300 nm., wherein the light source is of the type producing a beam having substantial energy in the 100-300 nm. wavelength range.

7. The system of claim 1, wherein the room sensor includes an enclosure having a plurality of walls and enclosing the chamber, and including at least one baffle extending from an enclosure wall to the chamber.

8. The system of claim 1, wherein the room sensor includes an enclosure having a plurality of walls and enclosing the chamber, wherein the enclosure has interior surfaces, and said interior surfaces are light-absorbing.

9. The system of claim 1, wherein the room sensor includes an enclosure having a plurality of walls and enclosing the chamber, wherein at least one wall includes a vent in proximity to the openings in the chamber.

10. The system of claim 9, wherein the vent comprises a grate having two series of oppositely oriented and linearly staggered fins.

11. The system of claim 1 adapted to detect particles in recreational smoke combustion products having a maximum dimension in the range of approximately 100-300 nm., wherein the light source is of the type producing a beam having substantial energy in the 300-700 nm. wavelength range.

12. The system of claim 1, including a driver providing power voltage to the light source, said power voltage periodically varying between two levels, wherein the light source provides a beam whose intensity is proportionate to the power voltage, and wherein the signal analyzer comprises a) a multiplier element receiving the power voltage and the sensor signal and providing a signal indicative of the product of a plurality of samples of each of the sensor signal level and the power voltage; and b) an integrator receiving the multiplier signal and integrating the values in the multiplier signal.

13. The system of claim 1, wherein the light source comprises a laser diode.

14. The system of claim 13, wherein the laser diode provides a light beam having one of a wavelength of 100-300 nm. and a wavelength near 650 nm.

15. The system of claim 1, wherein the light source is mounted to place the beam in closer proximity to the sensor's sensing surface than to an opposite wall of the chamber.

* * * * *